US009782310B1

(12) United States Patent
Khaligh

(10) Patent No.: US 9,782,310 B1
(45) Date of Patent: Oct. 10, 2017

(54) NAHO HEADREST

(71) Applicant: Shahzadeh Khaligh, Rancho Palos Verdes, CA (US)

(72) Inventor: Shahzadeh Khaligh, Rancho Palos Verdes, CA (US)

(73) Assignee: Space Technology Research LLC, Rancho Palos Verdes, CA (US)

( * ) Notice: Subject to any disclaimer, the term of this patent is extended or adjusted under 35 U.S.C. 154(b) by 0 days.

(21) Appl. No.: 14/998,583

(22) Filed: Nov. 1, 2015

(51) Int. Cl.
*A61G 5/12* (2006.01)
*A61G 5/10* (2006.01)

(52) U.S. Cl.
CPC ..... *A61G 5/12* (2013.01); *A61G 5/1043* (2013.01); *A61G 2005/121* (2013.01)

(58) Field of Classification Search
CPC .... A47C 7/36; A47C 7/38; A61G 5/00; A61G 5/12; A61G 2005/121
See application file for complete search history.

(56) References Cited

U.S. PATENT DOCUMENTS 3,497,259 A * 2/1970 Sherfey ..... A61G 5/12 297/391
3,761,126 A * 9/1973 Mulholland ..... A61G 5/00 297/391
5,803,642 A * 9/1998 Sassmannshausen ..... F16C 11/0604 248/124.1
5,967,613 A * 10/1999 McKeever ..... A61G 5/12 297/397
6,419,321 B1 * 7/2002 Sack ..... A61G 5/12 297/405
7,207,630 B1 * 4/2007 Reynolds ..... A61G 5/12 248/118

* cited by examiner

*Primary Examiner* — Philip Gabler

(57) ABSTRACT

This invention pertains to medical accessories for wheelchairs. It specifically relates to a headrest system that can be attached to a wheelchair, medical chair, or bed for home use, hospitals or other medical centers. It is intended for use of patients with swallowing difficulties to prevent Aspiration Pneumonia during eating or drinking. This headrest would support the head in the proper position for deglutition that blocks the larynx entrance during swallowing and prevent food or drink from entering into respiratory system. Wherein, a serious problem for patients with lung diseases is, inhaling foreign material such as food and drink that could ultimately cause lung infection. This invention addresses this concern. The novelty introduced here is the design and technicalities of an attachable headrest with adjustable length and tilting head cushion. There is a wide variety of operation for this invention; this unit can be used in any private or public place such as private homes, hospitals, nursing homes, medical care centers, and alike.

4 Claims, 3 Drawing Sheets

The Front View of the Headrest in Standard Configuration

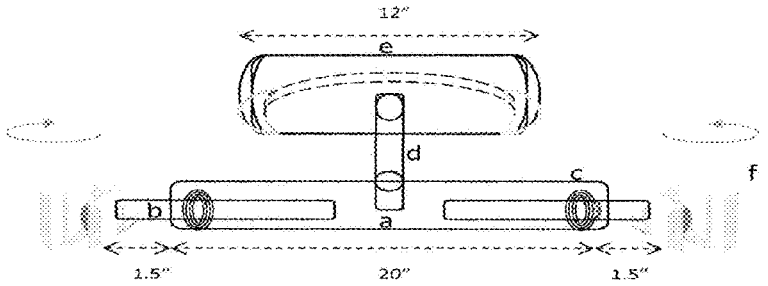
Figure 1: The Front View of the Headrest in Standard Configuration
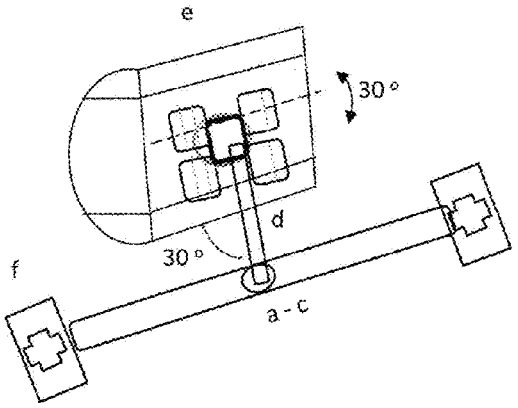
Figure 2: The Rear View of the Headrest
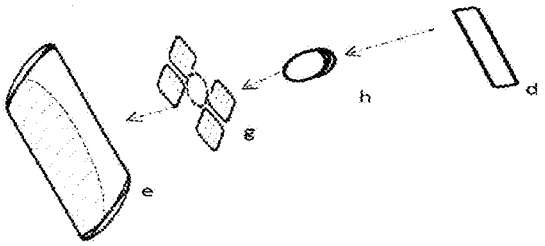
Figure 3: Assembly of the Components

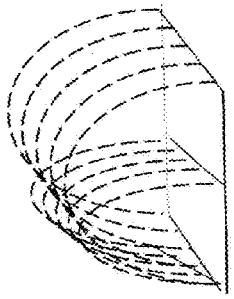
Figure 4: Side View of the padding (e) of the headrest
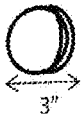
Figure 5: The Front View of Rolling Ball (h)
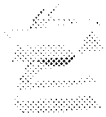
Figure 6: Rotated View of the Clamps (f)
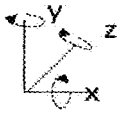
Figure 7: Rotational Direction of Clamps
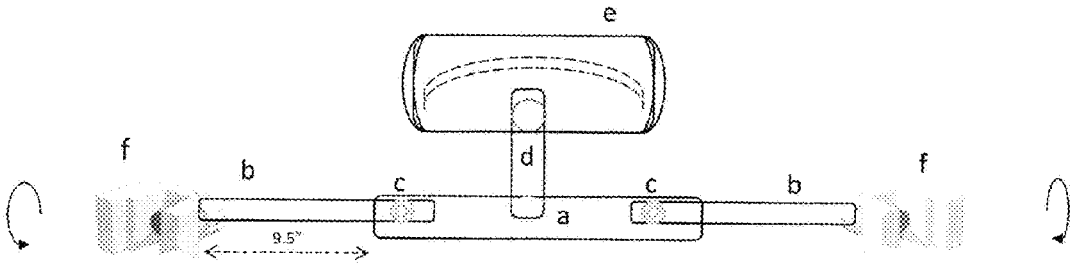
Figure 8: The Front View of the Headrest in Extended Configuration

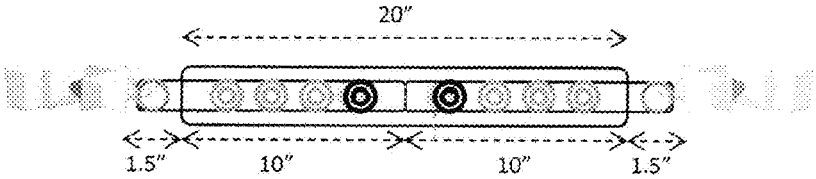
Figure 9: Top View - Horizontal Bar in the Standard Form (23")
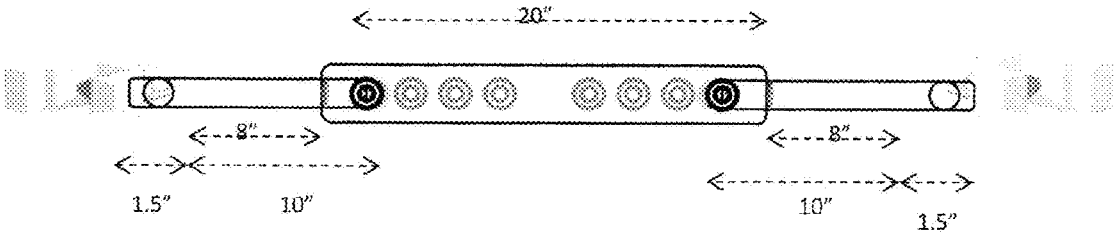
Figure 10: Top View - Horizontal Bar in the Extended Form (39")

NAHO HEADREST

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not applicable

FOREIGN APPLICATION DATA

N/A

BACKGROUND OF THE INVENTION

There is a considerable population suffering from aspiration pneumonia. Aspiration Pneumonia is a disease occurring as a consequence of entry of particles or substances into pulmonary system. If the patient is not able to cough out the aspirated material, then lung infection will occur.

Both food and air pass through Pharynx. Pharynx is a member of both the digestive system which includes esophagus and stomach, and the respiratory system which includes larynx, trachea and bronchi. Located at the posterior end of nasal airway and mouth, it splits into superior of larynx (respiratory system) and esophagus (digestive system).

Food through the process of swallowing passes from mouth to pharynx and into esophagus. Therefore, swallowing is the process of passing material from mouth into esophagus through pharynx while shutting the entrance to larynx. If a person does not swallow correctly, then food or liquid goes down the trachea (air tunnel) instead of the esophagus (food tunnel) that could result in choking or create pulmonary aspiration. Thus aspiration pneumonia develops as a result of the entrance of the foreign material into the bronchi. Larynx protects the trachea against the food aspiration by blocking the opening to pharynx. There are many factors that cause the process of swallowing fail. Muscles involved in the swallowing process are weakened by age, stroke, Alzheimer, or other diseases that lead to an incomplete swallowing mechanism, and as a result, possible pulmonary aspiration of foods or other particles. Most common solution to reduce the risk factors to pulmonary aspiration of food is to swallow safely. Incorrect physical form of the patient while eating plays a key role in inhaling the food. Medical experts instruct sitting up while eating, eating slowly, taking small bites, and most importantly swallowing with chin down. The chin-down position is the key to close the pharynx opening. This invention is intended to aid patients to obtain the "chin-down" position while swallowing which is the most helpful condition for prevention of food inhale. A sketch of head and neck illustrating the pharynx and larynx, and their connections relative to the esophagus and trachea is obtained from public domain and provided in Drawing 1 for better conception.

The head rest introduced here fills the back of the neck, and forces the chin to a lower position. After swallowing, if desired, the patient can rest his head on the head cushion to gain energy and also to slow down the eating process. When ready for a bite again, by removing his head from the cushion, the head pad resumes its tilt down position and pushes his chin down to allow the closure of the larynx and the entrance of the food through the proper channel in to esophagus.

If a caring assistance feeding the patient, then the head pad can be manually adjusted and controlled. In the standard setting, the head pad would hold the head strait and slightly in a forward position to support the chin down condition. When the patient rests his head on the cushion, the head pad would tilt back to give a comfort position for the patient's head. As soon as the patient removes his head from the cushion, the head pad will resume its original tilt forward condition to support the chin-down position.

This head rest can be attached to wheel chairs, beds with the bed board support, and any chair's configuration that can support the clamp's locking, and measures up to 39" wide.

SUMMARY OF THE INVENTION

This invention introduces an adjustable headrest that can be attached to any conventional wheelchair or commercial chair, for head support of patients during eating and drinking. The NAHO headrest has 6 degrees of freedoms via its 3 main components: the head pad, the vertical bar and the horizontal bar.

The head pad can tilt forward and backward up to 30 degrees around the x axis at its pivot; and is attached to the vertical bar on its backside. The vertical bar at top end is attached to the rear frame of the head pad at its center. At the bottom end, it is attached to the center piece of the horizontal bar, and can move up and down in the center piece for height adjustment. The horizontal bar is a three piece that typically fits wheel chairs of 23" wide but can be extended to a greater length for different sizes or settings up to 39" wide. A desired shorter length can be achieved by pushing the two side pieces in to the center piece and vise versa, by extending them out for a longer length. The center piece is 20" long and has 8 selector holes located 2" apart from the center line. Each side member is 11.5" long, and in the standard form, 10" situate in the center piece. Each side member can use, at the most, 4 of the holes located at its side for extension. There is a tab on each side members, 2" from the end, which locks into any of the selector holes to achieve the desired length. At the other end, each side member is connected to a clamp, which is used for attaching the headrest to the sitting or bedding arrangements. The clamps are adjustable and able to rotate in a full circle in 3 axes to accommodate different settings of the chairs. Additional height setting can be achieved by placing the bar at different height of the chair's arm and lock the clamps.

The primary purpose of this headrest is to manage the patients' chin down position and support the head so that it does not lean backward during eating or drinking. Elderly with fatigue conditions usually tend to lean their heads to the sides or mostly to the back to rest on something. Moving the head to the side or back allows larynx opening into pharynx that would result the food move into trachea. One most effective way to keep the larynx opening blocked during eating is to keep the chin down. This headrest assists managing the head in the chin down position. In case of swallowing complications, the food would move down through the proper channel to esophagus and digestive system since that is the only opening at the pharynx.

Additional advantages are that patient can rest his head on the cushion in between the bites after swallowing to gain energy for the next bite. That would make the eating more pleasant for the patient, lower the speed of swallowing and improves the food digestion.

The technology introduced here is a new safety feature that prevents inhaling food or other substances due to swallowing failure. This design can be used for patient at home, in the hospital, or other medical facilities.

BRIEF DESCRIPTION OF THE VIEWS OF THE DRAWING

FIG. 1 illustrates the front view of the headrest in standard form.

FIG. 2 illustrates the schematic of the rear view of the headrest.

FIG. 3 illustrates the schematic of the side view of the padding, in detail.

FIG. 4 illustrates the assembly of the components of the head pad to the vertical bar.

FIG. 5 illustrates the roller from an angle for tilt operation.

FIG. 6 illustrates an arbitrary selected, a commercially made off the shelf, clamp.

FIG. 7 illustrates the 3-axes movement of the clamp.

FIG. 8 illustrates the extended view of the horizontal bar.

FIG. 9 illustrates the top view of the horizontal bar in the standard form, 23" wide.

FIG. 10 illustrates the top view of the horizontal bar in the maximum extended form, 39" wide.

DETAILED DESCRIPTION OF THE INVENTION

Referring to FIG. 1, the head pad (e) is attached to the center piece of the horizontal bar (a) via its vertical bar frame (d). The extension members of the horizontal bar, (b), are adapted to slide in to, and out of, the center piece, for desired length flexibility. The three-piece horizontal bar is able to adjust to a desired length by the 8 selector holes and tabs (c) up to 39" wide.

The cushion preferably is filled with a mass of feather and air or foam rubber, covered by a layer of goose down fill and a soft fabric for enduring feelings and enjoyment of the patient. The lower portion of the padding is filled with slightly tighter compression that covers the curve in the neck of the patient. This configuration allows the head to maintain a forward position which is the correct and desired position for the airway to remain clear of the food intake. There are two clamps (f), located at each end of the horizontal bar which are used to attach the headrest to the patient's chair or bed. The clamps will lock tight with their screw knobs on the back. In this figure, the picture of the clamps is obtained from public domain for the purpose of illustration.

Referring to FIG. 2, the head pad's configuration comprises of a cushion, a bracket (g), a roll ball (h), and a spring that together will attach to the vertical bar. The rear frame of the head pad, made of plastic, is designed to attach to a holding bracket and in the center is attached to a roll ball. The bracket is screwed to the rear frame of the head pad on its 4 corners. The center of the bracket is designed to fit the rear frame of the roll ball, which is screwed to the vertical bar. The vertical bar requires a minimum of 5 inches clearance on the top to accommodate the 30 degrees tilt. On the lower end of the bracket there is a knob for spring attachment. The distance between the vertical bar and the head pad in the parallel position is about 3.5 inches that provides about 33 degrees tilt of the head pad.

FIG. 3 shows these connections in a serial configuration.

Referring to FIG. 4, the compression of the fillings in the upper and lower portion of the cushion from the side view is visualized.

Referring to FIG. 5, the rolling ball, mounted on the rear frame of the padding facilitates the tilting motion of the cushion.

Referring to FIG. 6, there is a clamp at each end of the horizontal bar that locks on to the arms of the chair or bed. These clamps are mounted to the side bars via a ring and can turn and rotate in 3 dimensional spaces. This flexibility allows the attachment of the horizontal bar to the arms of chair in any setting, or the bed siding. They can be attached to arms in parallel or perpendicular to the horizontal bar, and at different height or location. Once the clamps are located in the desired spot, it will be locked by tightening the knob on the clamp. The headrest can be positioned at any desired height by just locking the clamps at the desired location on the handle bar.

FIG. 7 visualizes the rotational axis of the clamps.

Referring to FIG. 8, the horizontal bar can be extended longer through its side members for use in a wider bed or chair. This figure illustrates the maximum extension of the horizontal bar. That is, the side members are locked in the very first selector tab of the center piece. The 3 piece together arrange the 39" wide settings.

There is a spring that is used as an additional accessory to automate the push down operation of the head pad. One end attaches to the knob located in the lower end of the bracket behind the head pad, and its other end hooks into a tiny hole on the vertical bar. This spring exerts no force to the head pad when there is no weight on it. The patient, after swallowing each bite, can rest his head on the head pad. Due to the weight on the cushion, the spring will extend longer to accommodate the tilt up position of the head pad. Once the patient removes his head from the cushion for taking the next bite, the spring will compress back to its natural length which brings the head pad down to tilt forward position. The use of the spring is an additional feature for those patients who tend to rest their head back on the pad. To disable this additional feature, the rolling ball on the back of the head pad can be locked in a fixed tilted down position for entire period of eating; or the spring can simply be removed.

Referring to FIG. 9, the center piece and side members, in the standard 23" length, are illustrated from the top view. There are 8 selector holes on the center piece, located 2" apart from the center line. The shortest length of the horizontal bar is achieved when the selector tab is locked in the last selector hole near the center line. That situates the 10" of each side member, inside the center piece, and leaves 1.5" out that together with the center piece provide 23" long horizontal bar.

Referring to FIG. 10, the horizontal bar is configured to its longest length, which is 39" wide. The side members' tabs are locked in the first selector hole in the center piece. That situates only 2 inches of each side member in the center piece. The three pieces together provides 39" in length.

This headrest is not foldable; therefore, it needs to be removed if folding the wheelchair is desired.

Product Specification

It is considered to use high strength plastic or light weight steal for the horizontal and vertical bars/frames. The frame of the pad is made of plastic and the pad is made of compressed foam and/or air and covered with a soft and durable fabric filled with a layer of goose dawn.

| | |
|---|---|
| Length of the horizontal bar | 23"-39" |
| Length of the center piece of horizontal bar | 20" |
| Length of the side members of the horizontal bar | 11.5" |
| Spaces between the selector holes | 2" |
| The size of the tab | ¼" |
| Height of the vertical bar | 10"-12" |
| Roll ball diameter | 3" |
| Size of the head pad | 11" H × 12" L × 3" W |
| Color | silver/grey/black |
| Manufacturer | Flexible |
| Brand | NAHO |

It is recognized that future modifications can be made to the present invention that could result in an improved model or application, yet it might be within the scope and convergence of this invention.

The claims here are:

1. An adjustable tiltable headrest system configured for attaching to a wheelchair, the system comprising:

A 3-piece bar structure including a center bar member having a plurality of holes arranged along an axis of the bar member, and 2 adjustable side bar members, each slidable in the center bar member, wherein the inner end of each side bar member has at least one tab configured to engage with a hole of the center member to lock a desired position of the side bar member relative to the width of wheelchair, and the outer end equipped with a rotating clamp configured for attachment to the wheelchair;

A head pad comprising a frame supporting a cushion, the frame movably mounted to a bracket via a ball mount that provides adjustable tilt for the frame and cushion relative to the bracket; and A vertical bar connecting the bracket of the head pad to the center bar member;

Wherein a spring with one end attached to the bracket and another end attached to the vertical bar serving to maintain the head pad in a tilt-down position, with flexibility to move slightly upward when a user exerts a force on the head pad.

2. The headrest system of claim 1, wherein each rotating clamp comprises a grip and knob configured for locking the clamp to the wheelchair.

3. The headrest system of claim 1, wherein the vertical bar is slidably mounted to the center bar member to provide an adjustable height of the head pad.

4. A method of using the headrest of claim 1 comprising the steps of

1. Providing the proper head position for the user, during eating and drinking
2. allowing the user to rest his head on the headrest while taking time to eat.

* * * * *